United States Patent [19]

Gibbons

[11] Patent Number: 4,850,313

[45] Date of Patent: Jul. 25, 1989

[54] CRUCIFORM ENGINE

[76] Inventor: Peter Gibbons, 894 Capital, Costa Mesa, Calif. 92627

[21] Appl. No.: 155,823

[22] Filed: Feb. 16, 1988

[51] Int. Cl.[4] ..... F02B 75/22

[52] U.S. Cl. ..... 123/55 R; 123/193 P; 92/227

[58] Field of Search ..... 123/55 R, 55 A, 193 P, 123/192 B; 92/212, 178, 227

[56] References Cited

U.S. PATENT DOCUMENTS

| | | | |
|---|---|---|---|
| 1,361,109 | 12/1920 | Spohrer | 123/90.14 |
| 2,132,595 | 10/1938 | Bancroft | 123/56 AC |
| 3,175,544 | 3/1965 | Hughes | 123/55 R |
| 3,258,992 | 7/1966 | Hittell | 123/56 BC |
| 3,606,870 | 9/1971 | Llewellyn | 123/56 C |
| 3,641,828 | 2/1972 | Ryan | 74/49 |
| 3,842,812 | 10/1974 | Marcus | 123/90.14 |
| 3,921,602 | 11/1975 | Froumajou | 123/64 |
| 3,946,706 | 3/1976 | Pailler | 123/197 AB |
| 4,173,151 | 11/1979 | Grundy | 74/49 |
| 4,270,395 | 6/1981 | Grundy | 74/49 |
| 4,450,754 | 5/1984 | Liljequist | 123/193 P |
| 4,455,974 | 6/1984 | Shapiro et al. | 123/193 P |
| 4,672,931 | 6/1987 | Biagini | 123/193 P |

FOREIGN PATENT DOCUMENTS

| | | | |
|---|---|---|---|
| 2908333 | 9/1980 | Fed. Rep. of Germany | 123/56 AC |
| 0212301 | 12/1982 | Japan | 123/197 AB |

*Primary Examiner*—David A. Okonsky

*Attorney, Agent, or Firm*—Georges A. Maxwell

[57] ABSTRACT

A cruciform internal combustion reciprocating engine characterized by two right angularly related pairs of axially spaced cylinders with related piston units including pairs of axially aligned, axially spaced pistons, each piston is engaged in one of the cylinders. The pistons of each unit are rigidly connected by an elongate yoke. A crank shaft has an eccentric crank pin at right angle to the axes of and positioned between the cylinders of the pairs of cylinders. A double isosceles sliding block linkage motion-translating mechanism drivingly couples the crank pin and the yokes and includes a twin eccentric disc driver rotatably carried by the crank pin with the discs thereof rotatably engaged with the yokes. The pistons of the piston units include elongate annular bearing sleeves in rotary bearing engagement about the pistons and in linear sliding and rotary bearing engagement with the bores of related cylinders. The bearing sleeves transmit high side loading forces directed onto the pistons by the motion-translating mechanism and their related yokes onto the cylinders as the pistons approach both top and bottom dead center. The bearing sleeves maintain the pistons aligned in their cylinders and guide the piston units linearly as they reciprocate.

19 Claims, 6 Drawing Sheets

Fig. 2.
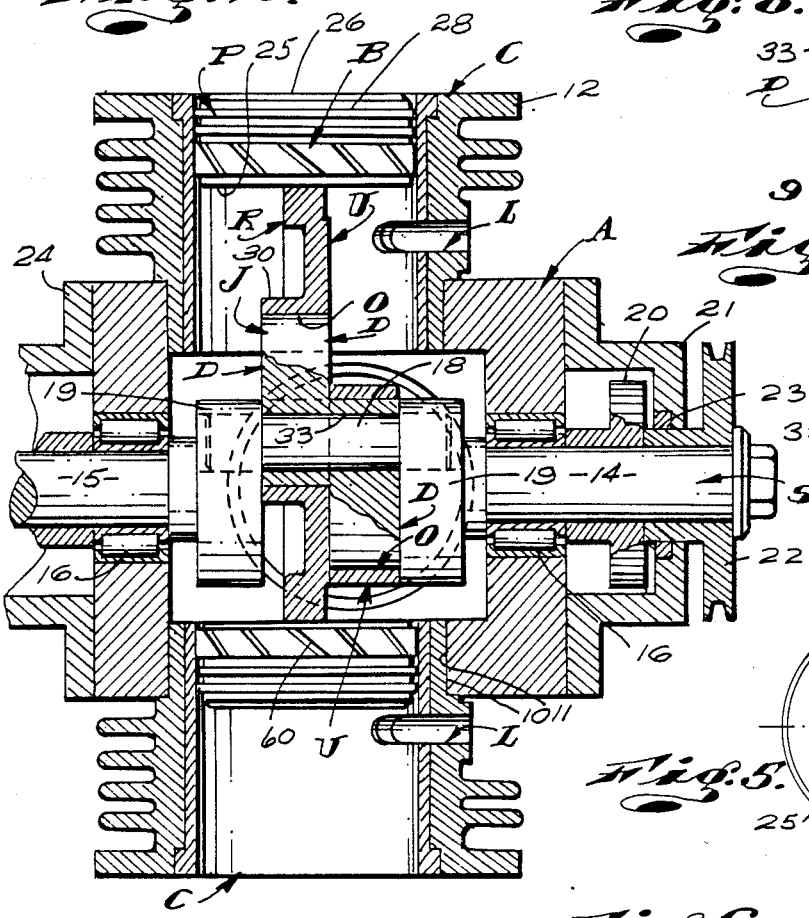
Fig. 8.
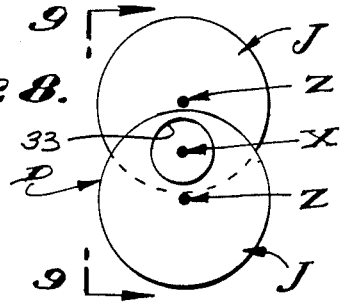
Fig. 9.
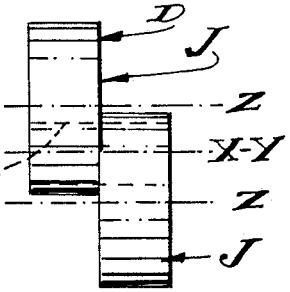
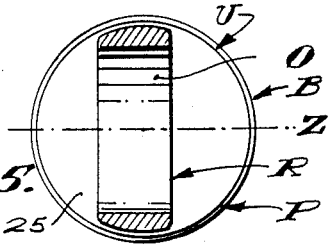
Fig. 5.
Fig. 6.
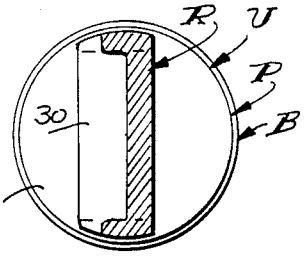
Fig. 3.
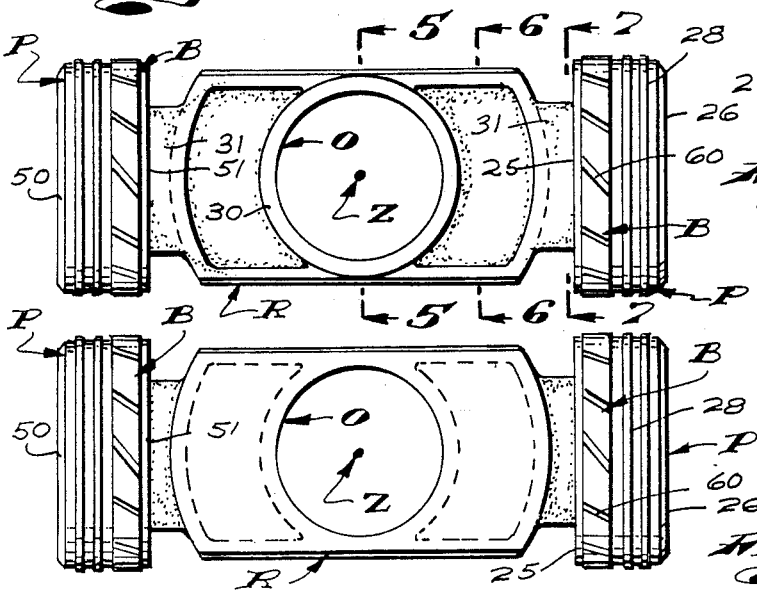
Fig. 7.
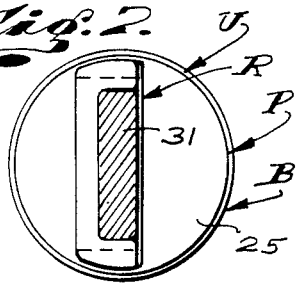
Fig. 4.

CRUCIFORM ENGINE

BACKGROUND OF THE INVENTION

The present invention has to do with that unique form of internal combustion reciprocating engine which is characterized by two or more pair of axially aligned, oppositely disposed cylinders, pistons within the cylinders and a single connecting yoke fixedly secured to and extending between the pistons in each pair of cylinders. The longitudinal axis of each pair of cylinders is angularly related to the longitudinal axis of each of the other pairs of cylinders and intersects and is at right angle to a crank shaft on the central turning axis of the engine.

This invention is further concerned with the above noted form of engine which includes a double isosceles sliding block linkage motion-translating mechanism including a unitary twin eccentric disc driver engaged with and between the yokes of the related pairs of pistons and the crank shaft and which functions to translate the reciprocating motion of the connecting rods into convenient-to-use rotary motion at the crank.

The simplest form of engine of the character referred to above is a four-cylinder engine consisting of two pairs of cylinders arranged with their central longitudinal axes at right angle to each other, in the nature of a "cross". Due to their above-noted configuration, such engines have been appropriately described as "cruciform engines".

In practice, cruciform engines can be made with three or more related pairs of cylinders. In such engines, the basic geometry of the engines remains the same, and they are appropriately defined as "cruciform-type" engines.

The double isosceles sliding block linkage motion-translating mechanism referred to above and which I utilize in my new engine structure functions as and puts to use the same unique linkage that characterizes elliptic trammels. Accordingly, in the following, the motion-translating mechanism that I provide can, for the sake of brevity, be called the elliptic trammel-type motion-translating mechanism.

Cruciform engines with elliptic trammel-type motion-translating mechanisms are known to be old in the art. In the above cited *Popular Science* magazine article entitled "Esso Research Explores A Radical New Cruciform Engine," an internal combustion cruciform engine with a twin eccentric disk drive part that is understood and believed to be a part of an elliptic trammel-type motion-translating mechanism is illustrated. For the purpose of this disclosure, the engine which is the subject of the noted magazine article will be referred to as the Esso engine.

In the *Popular Science* magazine article, it is noted that the basic layout of the Esso engine was traced back to about 1886, when Sir Charles Parsons, an Irish engineer of steam turbine fame, applied it to a piston steam engine, the layout of which was said to be "cruciform."

In accordance with the above, it appears well established that cruciform engines with elliptic trammel-type motion-translating mechanisms are old in the art.

In the *Popular Science* magazine article, the great potential and favorable attributes of and certain advantages afforded by such engines are particularly noted.

In the *Popular Science* magazine article, the failure of cruciform engines, in any form, to gain acceptance or to attain any notable commercial success is noted, but the cause for such failure is left to speculation.

When researching the prior art and when designing and operating prototype cruciform engines of the character referred to above, I found strong indication that in cruciform engines with elliptic trammel-type motion-translating mechanisms have exceedingly high lateral forces are directed through each related pair of pistons onto the walls of their related cylinders as those pistons reach the ends of their strokes; that is, as one of each pair of pistons reaches Top Dead Center and its other piston reaches Dead Bottom Center. Those high forces having been determined to be such that they generate such great fiction and heat at and between the cylinders and pistons, as the pistons approach the ends of their strokes, that the pistons and/or cylinders are caused to degradate rapidly and are so highly susceptible to premature failure and destruction as to render such engines impractical in the absence of supplemental bearing means to relieve the pistons from excessive lateral or side loading.

My above noted findings appear to be affirmed by the teaching of the above cited Reed H. Grundy patents. Reed H. Grundy makes specific reference to the above noted *Popular Science* magazine article in which the Esso engine is described. He further discloses an eccentric disc-type motion-translating means with right angularly related pairs of cylinders and related pistons, such as is provided in the Esso engine. Grundy recognized that in such engines excessively high and destructive lateral forces are encountered between the pistons and their cylinders near the ends of the strokes of the pistons. The essence of Grundy's invention is to eliminate the adverse and destructive effects of excessive lateral or side loading of the piston by secondary load transfer mechanisms that serve to direct lateral forces or loads otherwise transmitted through the connecting yokes and directed onto and through the pistons directly onto their related cylinders and/or onto the crank case of the engine and to thereby relieve the pistons from all lateral loading. It appears that Grundy understood and believed that the adverse side loading on the pistons in his and other similar engines was caused by the inability of the crank and connecting yoke structures of such engines to accommodate the loads encountered and resulting lateral displacement and/or deflection thereof. He appears to suggest and teaches that lateral displacement and/or deflection of the crank of his engine caused lateral displacement of the connecting yokes and that lateral displacement and deflection of the connecting yokes resulted in urging the pistons laterally into engagement with their related cylinders with destructive force. To counter the foregoing, Grundy teaches unique primary load carrying mechanisms to intermittently support and prevent displacement of the crank pin of his crank shaft; and, a secondary load carrying mechanism comprising lubricated linear bearing structures at and between opposite side edges of the connecting yokes and spanning the crank case structure of his engine.

In his disclosure, Grundy inaccurately illustrates and ascribes the manner in which the forces in cruciform engines with elliptic trammel-type motion-translating mechanisms are directed. He shows and describes the lateral forces applied onto and through the pistons in a direction opposite to the true direction in which such forces are applied. In the structure he discloses, the link mechanism embodied therein is that of an elliptic trammel and the piston and yoke assemblies are link parts that react with their related cylinders in a direction other than to that which he teaches.

While Grundy's efforts to eliminate the adverse effects of side loading of the pistons in engines of the character here concerned with are understood and believed to be totally ineffective, Grundy's teachings are nonetheless highly significant since they point clearly to the fact that the critical problem of side loading of the pistons in such cruciform engines was a long recognized and yet to be resolved problem as late as 1979. Grundy's teachings also point to the extreme ends that others have undertaken in efforts to overcome the noted problem of excessive side loading of the pistons in cruciform engines and to make such engines practical.

OBJECTS AND FEATURES OF THE INVENTION

It is an object of my invention to provide an improved cruciform engine with an elliptic trammel-type motion-translating mechanism and including novel bearing structure between the pistons and their related cylinders to allow for substantial free linear movement of the pistons in the cylinders when high side loading therebetween is encountered.

It is an object and feature of my invention to provide an engine of the general character referred to above wherein said bearing structure includes bearing sleeves engaged in radially outwardly opening annular channels in skirt portions of the pistons and which establish sliding bearing engagement within their related cylinder wall.

Yet another object and feature of my invention is to provide an engine of the general character referred to above wherein the bearing sleeves are movable axially within their channels and relative to the longitudinal axes of the pistons.

Another object and feature of my invention is to provide an engine of the character referred to wherein the bearing sleeves are movable circumferentially within their related channels and relative to their related pistons and cylinders to assure uniform wear of and free relative movement of the bearing parts.

An object and feature of my invention is to provide an engine of the general character referred to above wherein the bearing sleeves are established of a material or materials having a high index of heat conductivity and that are notched and/or grooved to establish increased surface area to radiate and dissipate heat and to induce circumferential movement of the sleeves relative to the pistons and cylinders.

It is an object and feature of my invention to provide an engine of the general character referred to above wherein the distance of axial travel of the bearing sleeves relative to the pistons is substantially equal to the distance of axial movement of the pistons during that portion of their travel where critical high lateral forces and escessive side loading of the pistons is likely to be encountered.

Another object of my invention is to provide an engine of the general character referred to which is a 2-cycle, supercharged engine with novel spring-loaded, gas pressure operated, inlet valve mechanisms.

The foregoing and other objects and features of my invention will be apparent and will be fully understood from the following detailed description of one preferred embodiment of my invention throughout which description reference is made to the accompanying drawings.

DESCRIPTION OF THE FIGURES

FIG. 2 is a sectional view of a portion of the engine shown in FIG. 1 and taken as indicated by line 2—2 on FIG. 1;

FIG. 3 is a view showing one side of a piston unit;

FIG. 4 is a view of the other side of the piston unit;

FIGS. 5, 6 and 7 are sectional views taken as indicated by lines 5—5, 6—6 and 7—7 on FIG. 3;

FIG. 8 is an end view of a driver part;

FIG. 9 is a view taken as indicated by line 9—9 on FIG. 8;

FIGS. 10A through 15A are kinematic diagrams of the engine with parts in different positions;

DETAILED DESCRIPTION OF THE INVENTION

The present invention can be advantageously embodied in substantially any multi-cylinder reciprocating engine including two or more pairs of axially spaced, axially aligned cylinders; a reciprocating piston unit related to each pair of cylinders and including a pair of axially spaced oppositely disposed pistons engaged in the cylinders and a single connecting yoke fixed to and extending between the pistons; a common crank shaft on an axis at right angle to and intersecting the longitudinal axes of the reciprocating piston units; and, an elliptic trammel-type motion-translating mechanism including a twin eccentric disc driver part in rotary driving engagement with each yoke and in rotary driving engagement with said crank shaft.

The invention can be embodied in reciprocating engines driven by motive fluids such as steam, air and oil, under high pressure, and can be embodied in internal combustion reciprocating engines in which hydrocarbon fuels such as oil, gasoline, ethanol and the like are burned and produce high pressure motive gases. Further, the invention can be embodied in air, water or oil-cooled engines and can be embodied in either two-cycle or four-cycle engines as desired or as circumstances require.

The most simple and basic form of multi-cylinder reciprocating engine of the type and/or class here concerned with includes two adjacent, right angularly related pairs of axially spaced, axially aligned cylinders; a reciprocating piston unit (as briefly described above) engaged with each pair of cylinders, a common crank shaft at right angle to and intersecting the axes of the pairs of cylinders and their related piston units; and, an elliptic trammel-type motion-translating mechanism including a twin eccentric disc driver part in rotary driving engagement with the piston units and in rotary driving engagement with the crank shaft.

In view of the crossed relationship of the axes of the two pairs of cylinders and due to the straight linear travel of the piston units, on right angularly related axes, the above noted form of engine has been previously defined as and is commonly called a "cruciform engine." In practice, when more than two pairs of cylinders with related piston units are provided, the basic geometry of the resulting engine remains essentially the same as that of the basic cruciform engine and such engines are appropriately identified as and are called cruciform or cruciform-type engines.

In accordance with the above, while my invention can be advantageously embodied in cruciform or cruciform-type engines with 6, 8 or more cylinders, I will, for the purpose of clarity, limit this disclosure to a basic four-cylinder cruciform engine.

Figure 1:
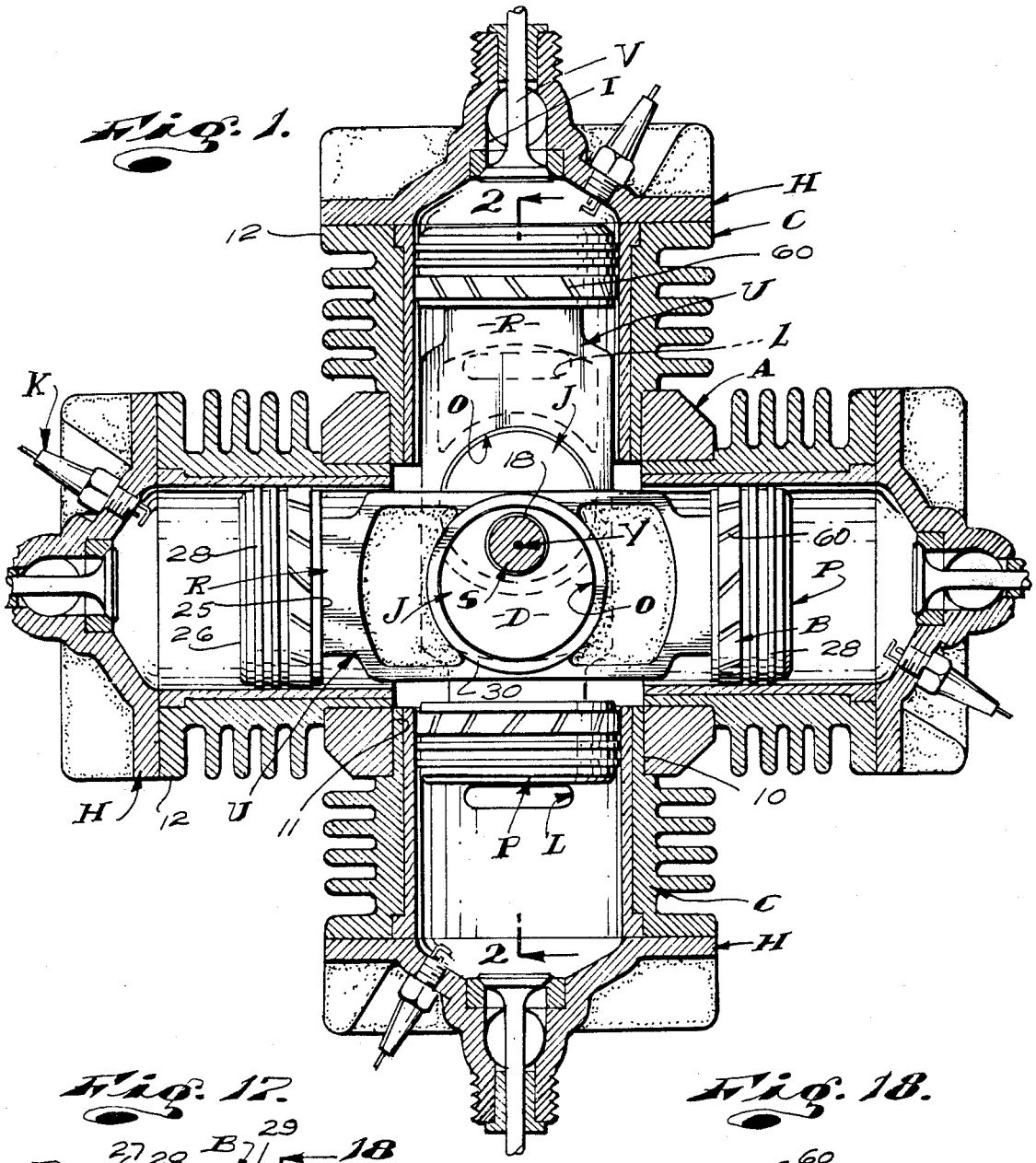
FIG. 1 is a cross-sectional view of an engine embodying my invention.

In FIGS. 1 and 2 of the drawings, I have illustrated a four-cylinder cruciform engine including one pair of axially spaced, axially aligned left and right cylinders C on a horizontal axis and another pair of axially spaced, axially aligned upper and lower cylinders C on a vertical axis. The right angularly related axes of the first two pairs of cylinders are at right angle to and intersect the central turning axis X of the engine on and about which a crank shaft S rotates.

The cylinders C are shown as elongate cylindrical units with exterior cooling fins and are shown suitably sleeved.

The cylinders have inner end portions engaged in and secured to a suitable crank case A. In the case illustrated, the inner end portions of the cylinders are reduced, as at 10, and are slidably engaged in related openings 11 formed in the case A, with their upper portions stopped on the case. The cylinders can be welded or otherwise fixed to the case or can be releasably secured to the case by suitable screw-fastening means (not shown).

The radial outer ends of the cylinders have mounting flanges 12 on and to which suitable heads H are releasably secured by screw fastener means (not shown) in accordance with common practice.

In the form of the invention illustrated and as shown in FIG. 2 of the drawings, the horizontal and vertical axes of the two pair of cylinders are axially offset from each other and relative to the central turning axis X of the engine to allow for necessary alignment and juxtapositioning of parts in accordance with old and established practices in the design and construction of engines.

The crank shaft S is an elongate assembly comprising axially spaced, opposite end parts or portions 14 and 15 projecting through and from the opposite, right and left-hand ends of the case A and which are rotatably supported by suitable anti-friction bearings 16 set in openings 17 in the case. The crank next includes an elongate axially extending, central crank pin 18 that occurs on an axis Y is radially offset from and parallel with the axis X. The crank shaft S next includes appertured crank arms 19 formed interedly on or otherwise suitably secured to and projecting radially from the inner ends of the end parts 14 and 15. The ends of the crank pin 18 are press-fitted into the appertures in their related crank arms 19.

In practice, one or both of the end portions or parts 14 and 15 of the shaft S can be utilized to perform desired work. In FIG. 2 of the drawings, the right-hand end portion 14 of the shaft occurring outward of the case A carries a gear wheel 20 within a chamber defined by an end plate 21 that is screw-fastened or otherwise secured to the case. The part 14 also carries a pulley wheel 22 axially outward of the plate 21. The gear wheel 20 can, for example, be a timing gear to drive valving and/or ignition means for the engine or do other desired or necessary work and the pulley wheel 22 can be utilized to do yet other necessary or desired work, as circumstances might require.

A suitable oil seal 23 is shown carried by the end plate 21 and engages a hub portion on the wheel 22 that extends through an opening in the plate 21.

In practice, the left-hand end part 15 of the shaft S might carry similar or different gear and/or pulley wheels to perform desired work and is suitably related to an end plate 24 at the left-hand end of the case A, similar to end plate 21, so that desired sealing about the shaft and the like can be effected.

The engine next includes two like double-headed piston units U. Each unit U is related to one of the noted pair of cylinders. Each unit U includes a pair of axially spaced, axially aligned and oppositely disposed pistons P positioned within one of the cylinders of its related pair of cylinders for substantial free reciprocating movement therein. Each unit U further includes an elongate, intermediate connecting yoke R securely connected with or fixed to and extending between its related pistons P. The pistons P are cylindrical parts with axially inwardly and outwardly disposed ends 25 and 26. The pistons are slightly smaller in outside diameter than the inside diameter of the cylinders and have a plurality (two) of axially spaced, radially outwardly opening annular ring grooves 27 in their outer end portions and in which cylinder bore-engaging piston rings 28 are engaged, in accordance with common practices. In addition to the foregoing, the inner skirt portion of each piston P is provided with a radially outwardly opening annular bearing channel 29 in which an annular bearing sleeve B is engaged. The nature and purpose of the bearing B will be considered in greater detail in the following.

The connecting yoke R of each unit U is a flat bar-like part substantially rectangular in cross-section. The effective length of the connecting yoke R is such that when one of its pistons is at top dead center in its related cylinder the other of its related pistons is at bottom dead center in its related cylinder. The major cross-sectional extent of the connecting yoke is slightly less than the inside diameters of the cylinders and the minor cross-sectional extent thereof is sufficient to impart the yoke with necessary rigidity and strength.

The flat central plane of each connecting yoke extending through its major cross-section occurs on and is coextensive with the central longitudinal axis of the unit U and is normal to the central turning axis X and the axis Y of the engine.

Each connecting yoke R has a large, central bearing opening O intermediate to its ends and on an axis Z that is normal to the said central flat plane of the yoke and which is offset from and parallel with the turning axis X of the engine and the axis Y of the crank pin 18.

In the form of the invention illustrated, the yokes R of the two units U occur adjacent to each other and have flat, opposing inner bearing surfaces that normally occur in close free running clearance with each other. The noted surfaces are parallel with the central planes of the yokes. The opposite or outer surfaces of the yokes need not be smooth or flat and can, as shown, be relieved or recessed to reduce the mass of the yokes, in accordance with good design practices.

In practice and as shown, the yokes R can be provided with central cylindrical outwardly projecting bosses 30 concentric with the openings O to materially increase the bearing surface areas in the openings O, as desired or as circumstances require.

In the form of the invention illustrated, the lateral extent of the end portions of the yokes is suitably reduced, as at 31, to facilitate connecting the pistons P thereto and to faciliate the manufacture and assembly of the pistons.

Figure 17:
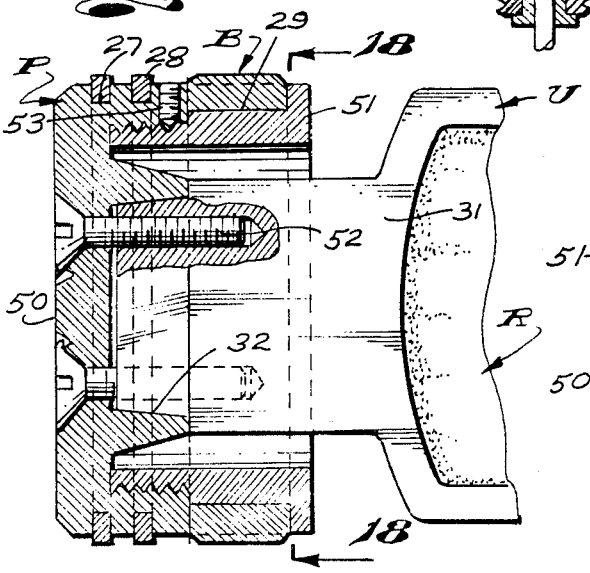
FIG. 17 is a sectional view of a piston assembly.

As shown in FIG. 17 of the drawings, each piston is formed with a central, radially inwardly opening recess 32 in which its related end portion 31 of its related yoke is engaged and suitably fixed.

The engine structure next includes a unitary driver D shown in FIGS. 8 and 9 of the drawings. The driver D is cooperatively related to the crank shaft S and the connecting yokes of the pair of piston units U to cooperate therewith and define that motion-translating mechanism that translates reciprocating motion of the piston units U into rotary motion of the crank shaft S.

The twin eccentric disc driver D is an elongate part, the central longitudinal axis of which is at right angle to and intersects the axis Y of the crank pin 18 of the crank shaft S. The driver D has a central crank pin opening 33, intermediate its ends, which opening is concentric with the axis Y of the crank pin 18. The crank pin 18 is rotatably engaged in and extends through and from the opposite ends of the opening 33 in rotary bearing engagement therein.

The driver D is formed to define two longitudinally offset, cylindrical journal discs J, the central axes Z of which are spaced from and parallel with the axis Y of the opening 33 and the pin 18. Each disc J is concentric with and is rotatably engaged in the bearing opening O of the yoke R of its related piston unit U. The axes Z two discs J are radially offset relative to each other relative to the longitudinal axis of the driver D and have related inner sides or halves that occur in adjacent overlapping relationship. The central crank pin opening 33 which extends through both discs J and defines the axis Y occurs in and extends through the overlapping portions of the pair of discs, as clearly shown.

Each disc J has two turning axes, that is, it has a primary, central, turning axis Z about or relative to which its related connecting yoke R turns and has a secondary eccentric turning axis Y spaced radially outward from its axis Z and which is coincidental with the axis Y or the crank pin 18, about which the disc turns. Accordingly, each disc J is appropriately defined as an eccentric disc with respect to the crank pin 18 about which it turns.

Considering the driver D as a unit or whole, it has three turning axes, that is, a central turning axis Y which is concentric with the axis of the crank pin 18 and about which the entire driver turns, and two second eccentric axes Z spaced radially outward from the axis Y, at opposite side thereof, and about which the connecting yoke R related to each of those eccentric axes turns.

When the pair of pistons P of one piston unit U are at top and bottom dead center, the pistons of the other, right-angularly related piston unit U are mid-way between their top and bottom dead center positions or are at a point of engine rotation that is ninety degrees (90°) from that point of engine rotation where they would be at top and bottom dead center. Accordingly, the central turning axes Z of the two journal discs J of the driver D, about which their related connecting rods turn, occur at opposite sides of the turning axis Y, about which the whole of the driver D turns.

It is to be noted that the axis Y, about which the driver D turns, turns in an orbital path about the axis X during operation of the engine. Accordingly, the whole of the driver D moves in an orbital path about the axis X as it rotates about the axis Y during engine operation and in what will be defined as a tumbling motion.

The driver D has a central radial plane that is substantially coincidental with the radial planes of the opposing inner bearing surface of their related connecting yokes R. The discs J are sufficiently greater in axial extent than the axial extent of the openings O in the yokes R to provide for desired running clearances and have outer end surfaces that oppose and establish running clearance with related portions of the crank arms 19 of the shaft S.

To facilitate assembly of the engine parts, the case A is preferably a split or two-part case, the parts of which are normally screw-fastened together and which is such that the case can be disassembled and opened to facilitate assembly and disassembly of the engine, in accordance with old and well-known practices.

When assembling the "short block" of the engine, the eccentric discs J of the driver D are engaged in the openings O in the juxtapositioned drive yokes R. Thereafter, the crank pin 18 is engaged in and through the opening 33 in the driver D. Following the above, the opposite end portion of the crank are entered into the case and into engagement with the pin 18. Thereafter, assembly of the "short block" of the engine is completed by installation and/or application of the anti-friction bearings, seals, end plates, and the like.

It will be apparent that, in practice, if desired or if circumstances require, suitable anti-friction roller bearing means or the like can be provided in the openings 32 and about the crank pin 18 and in the openings O and about the discs J. Also suitable thrust bearing means can be provided between the connecting yokes and/or between those yokes and their related crank shaft arms, as desired or as circumstances require. Further, if required, suitable thrust bearing means can be provided to maintain the shaft S in proper axial position within the case A.

The above referred to heads H, which heads are secured to and close the outer ends of the cylinders C are shown as finned, air-cooled heads. In accordance with common practice, the heads are formed with inlet ports I with suitable inlet valves V related thereto to provide for controlled intermittent flow of combustible charges of air and fuel (gasoline) into the cylinders.

Any appropriate carburetor or other air and fuel metering and mixing means together with any appropriate intake manifold structure can be provided to meter the air and fuel and to deliver the resulting combustible mixture within it to the inlet ports and valves of the several heads.

The heads are also provided with spark plug openings in which spark plugs K are engaged. The spark plugs K operate to ignite the combustible charges delivered into the cylinders. The spark plugs can be connected with and supplied with necessary spark-generating electric current by any one of the many suitable and available automotive ignition systems that one skilled in the art might elect to use. The ignition system employed can be timed with and/or driven by the crank shaft S, as by means of the gear wheel 20. Since the ignition system in no way effects the novelty of my invention and can vary widely in form, I have elected not to illustrate such a system and will not burden this disclosure with further description thereof.

Since the engine I have elected to illustrate is a two-cycle engine, the cylinders C are provided with suitable exhaust ports L in their lower end portions. The ports L can be suitably connected with any appropriate or suitable exhaust manifold structure in accordance with common practices.

Having illustrated and described the basic structural details and features of the engine, particular attention will now be directed to the rule of action and the kinematics of the engine.

In FIGS. 10 through 15 of the drawings, I have diagrammatically illustrated the short block of the engine with parts in six different positions. FIGS. 10A through 15A, which occur below FIGS. 10 through 15, illustrate the kinematics of the engine in each of the positions illustrated.

It is to be noted and will be apparent from a study of FIGS. 10A through 15A that the engine here provided applies the principle of the four bar double isosceles sliding block linkage that is applied in elliptic trammel devices and which is, therefore, commonly called an "elliptic trammel" linkage when used in other mechanisms and gives rise to qualify them as elliptic trammel machines.

Figures 10, 11, 12:
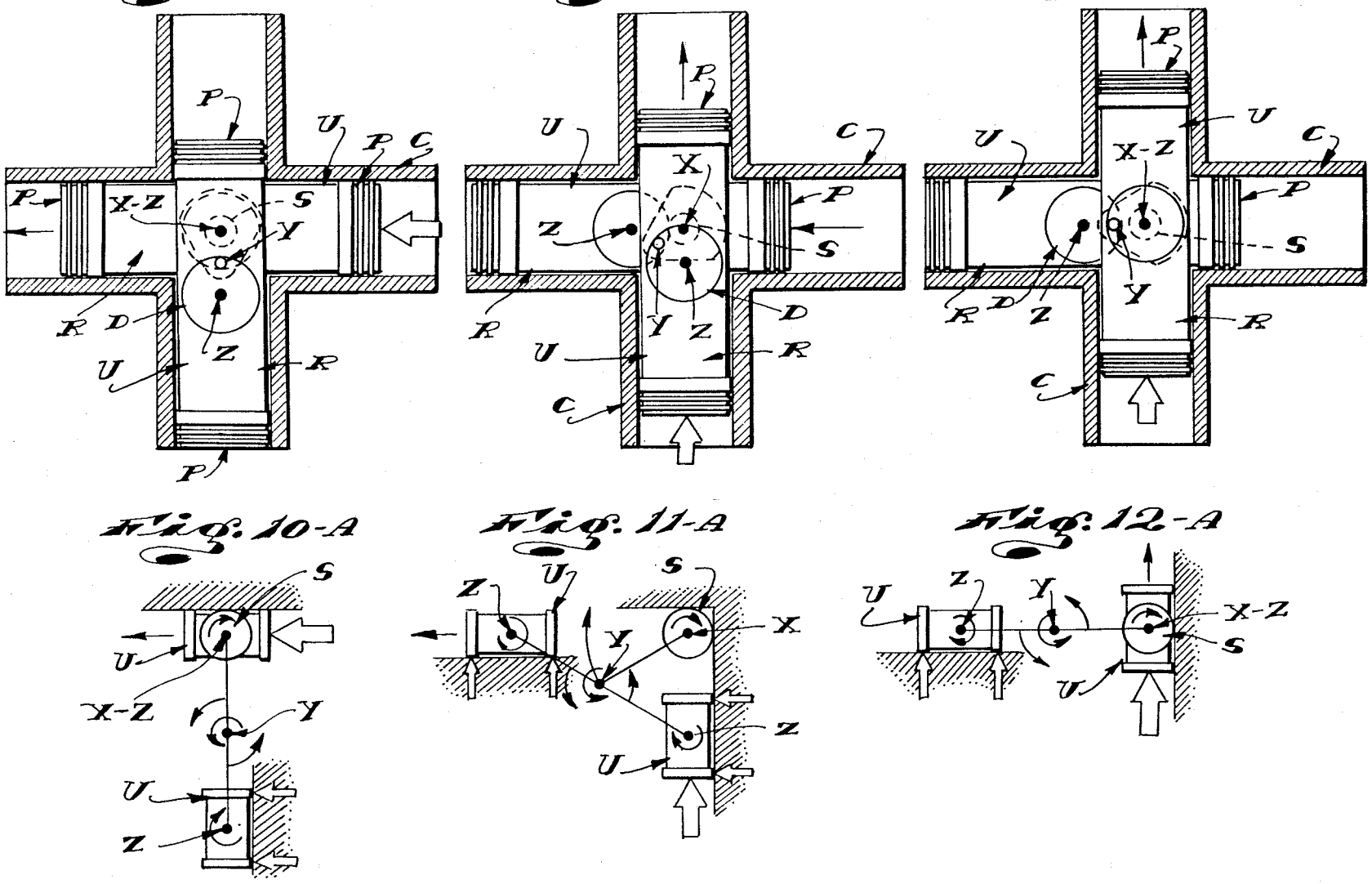
FIGS. 10 through 15 are diagramatic views showing parts of my engine in different positions.

In FIG. 10 of the drawings, the top and bottom pistons P of the vertically disposed or first piston unit U are stopped at their bottom and top dead center positions in their related cylinders. The several axes X, Y and Z within the engine are in vertical spaced alignment. The left and right-hand pistons of the horizontally disposed or second piston unit U are in their mid position, that is, they are mid-way between top and bottom dead center.

The right-hand piston is in its power stroke and is being urged to the left toward bottom dead center at near maximum force and maximum velocity. The left-hand piston is in its compression stroke and is being urged at maximum velocity to the left and toward top dead center, against minimal resistance afforded by gases being compressed thereby.

Referring to FIG. 10A, when the engine is in the position shown in FIG. 10, the theoretical links are in vertical alignment, the loads at the axis Y are equal and opposite, and the linkage between the two axes Z turn counterclockwise about the axis Y and direct all of the forces directly onto and through the first or vertical piston unit U, laterally to the right, subjecting the pistons of the first piston unit to extremely high side or lateral loading, as indicated by the heavy arrows in FIG. 10A of the drawings.

In FIG. 11 of the drawings, the engine parts have moved to that position where they occur upon sixty degrees of engine rotation from the position of engine rotation shown in FIG. 10 of the drawings. When in this advanced position, the bottom piston P of the first unit U has commenced its upward power stroke and is accelerating. The top piston has commenced its compression stroke and is rapidly accelerating. The force acting upon the bottom piston is great. The second piston unit is rapidly de-accelerating, the work force acting on the right-hand piston is substantially spent and the resistance of compressed gas acting on the left-hand piston is near maximum, though it remains of minimal effect.

As indicated in FIG. 11A, the high applied force acting on the bottom piston is resolved in rapidly diminishing and minor side loading of the first piston unit U to the right and in increasing and near maximum side loading of the second piston unit downward.

In FIG. 12 of the drawings, the engine parts have moved to the position corresponding to ninety degrees of engine rotation (with respect to FIG. 10 of the drawings). The first piston unit is in mid position and is moving at maximum velocity and the second piston unit is stopped with its left and right-hand pistons at top and bottom dead center. During the last 30° of engine rotation and 10% of linear travel of the second piston unit, prior to reaching its stopped position at top dead center, vertical side loading of that unit reached maximum, as side loading of the first piston unit diminished to zero. Gradually, upon reaching its 90° after top dead center position and as illustrated in FIG. 12A of the drawings, side loading of the first piston unit reaches zero and then reverses or switches.

The above noted side loading on the piston units, added to the comparatively high values for side loads present in the elliptic trammel linkage, is highly significant and is such that it can, if not suitably and effectively compensated for, result in serious adverse effects. From that which has been taught by that prior art and of which I am aware, the noted dynamics of side loading of the piston units in cruciform engines was not recognized or, if recognized, its significance was not sufficiently appreciated so that appropriate and effective steps might have been taken to counter the adverse effects that such novel side loading works upon the engine parts.

Figures 13, 14, 15:
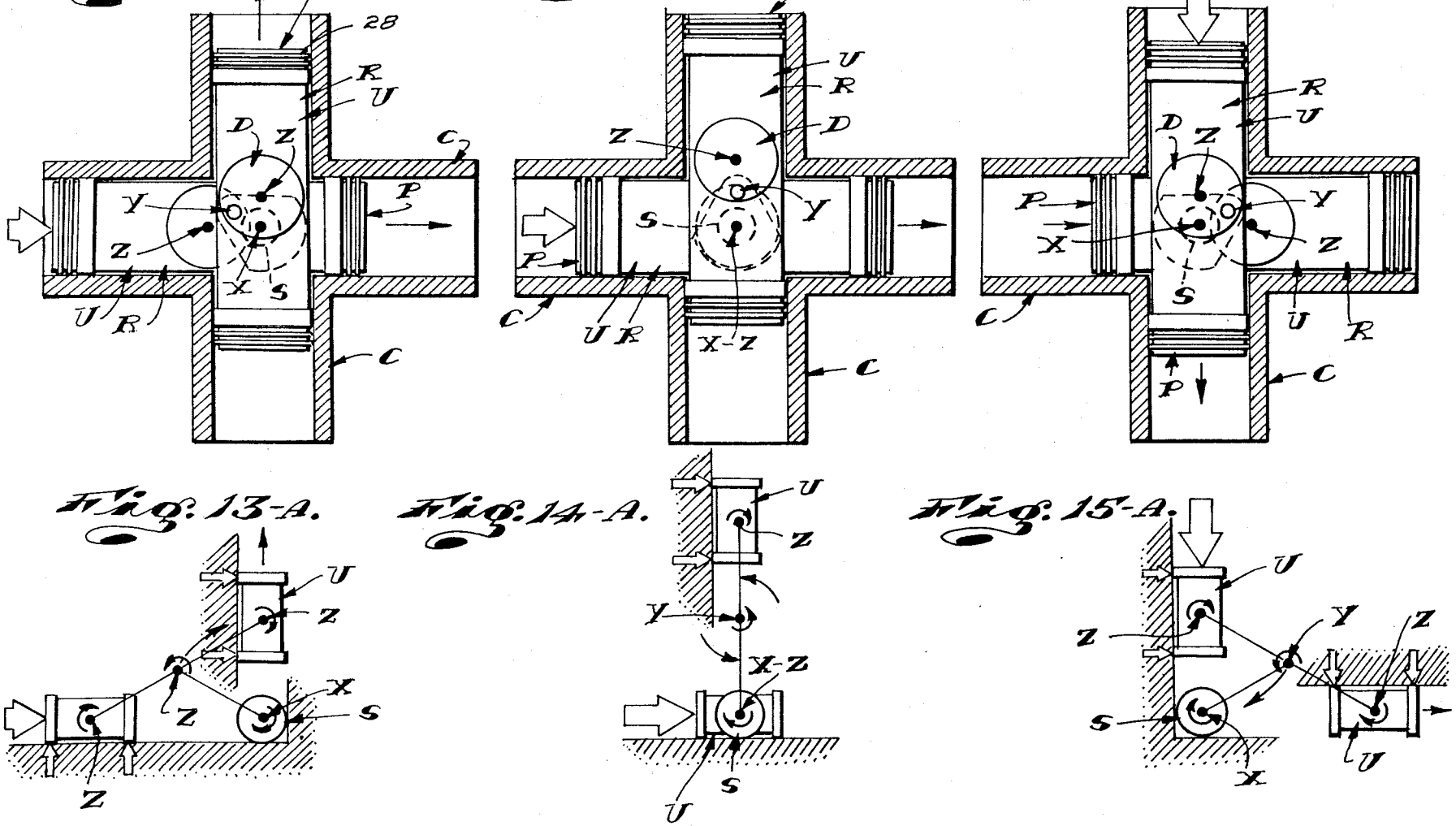

It is to be noted that in FIG. 12 of the drawings, the second and first piston units have assumed that position that the first and second piston units occupied in FIG. 10 and that, upon further rotation of the engine, repositioning of the engine parts will advance in a similar manner, as is shown in FIGS. 13 through 15 and in FIGS. 13A through 15A.

It has been determined that in a cruciform engine such as here provided, having a displacement of 200 cubic inches, a 4-inch stroke, turning at 5,000 rpm and developing 300 BHP, peak or maximum piston speed is 5,236 feet per minute, average side loading on each piston unit is 472.5 lbs., peak side loading of each piston units is 720 lbs., and peak side loading of the pistons P is 360 lbs. It is to be noted that side loading on the pistons commences to peak during the last $\frac{3}{8}\pm\frac{1}{8}$ inch of piston travel toward top and bottom dead center and remains significant as the pistons rapidly de-accelerate. Peak or maximum side loading is reached when the pistons are 30° from top and bottom dead center. Thereafter, side loading of the pistons commences to diminish as the pistons commence to move from and to top and bottom dead center.

Accordingly, side loading reaches peak value when the pistons are at 30° before and 30° after top and bottom dead center; remains near peak values as the pistons slow and stop at center; and commence to diminish after the pistons move beyond 30° after top and bottom dead center and accelerate in their next stroke.

The above described side loading of the pistons in cruciform engines of the class here concerned with is such that the frictional forces, friction-generated heat, variations in relative movement, and other related structural and dynamic factors working on and between the pistons and their related cylinders are such that ordinary or conventional piston structures such as are commonly employed in internal combustion reciprocating engines cannot withstand the forces working upon them and are soon scuffed, abrated, burned, deformed and otherwise worn and/or damaged to an extent that they render the entire engine inoperable. In the course of operating an engine with damaged pistons, their related cylinders are inevitably damaged to further adversely affect the operability and the utility of the engine.

In accordance with the above and in furtherance of my invention, the pistons P of the piston units U are provided with and carry the above-referred to cylinder-engaging bearing sleeves B. The bearing sleeves B are supported and carried by their related in substantially uniform running bearing engagement therewith and establish substantial uniform running bearing engagement with the bores or inside surfaces of their related cylinders. The bearing sleeves B are of substantial axial extent to provide adequate cylinder bore-engaging bearing surface areas at the two oppositely disposed loading or intermittently loaded sides of the pistons to effectively and efficiently transmit the maximum or peak side loading forces directed through the pistons onto the bores of their related cylinders, without adverse effects to the sleeves, pistons, or the cylinders.

The bearing sleeve of each piston preferably maintains sliding bearing and heat-conducting contact with the bore of its related cylinder at all times to assure effective and efficient conducting of friction-generated heat from the sleeve into the cylinder for subsequent dissipation and/or disposal.

The bearing sleeve of each piston preferably maintains sliding bearing and heat-contacting contact with its related piston to prevent free radial and/or lateral movement of the piston in its related cylinder and to conduct heat between the bearing sleeve and piston.

It will be apparent that the bearing sleeve B is such that it can only be used in a cylinder and piston assembly where piston movement or travel within the cylinder is and can be maintained truly linear.

Each bearing sleeve B is established of a suitable material or materials that have a low coefficient of friction with the materials of which the piston and cylinders (or cylinder sleeves) are established, which are sufficiently strong and stable to withstand the loads to be applied thereto and which are thermally stable in the environment in which they are to be used. It has been determined that my bearing rings might be advantageously established of a silver-impregnated porous aluminum alloy, a carbon composite, or a new bearing material produced by DuPont Corporation and marketed under its trade name Vespel.

Figure 18:
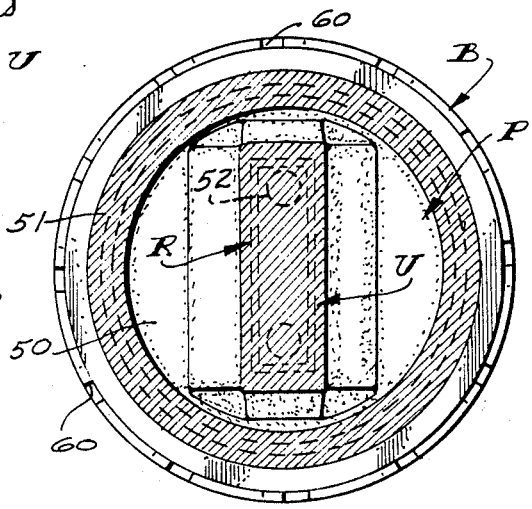
FIG. 18 is a sectional view taken on line 19—19 on FIG. 17.

In FIGS. 17 and 18, I have illustrated one piston structure that can be advantageously adopted and put to use in my new engine. The piston P shown in a 2-part structure, including a cylindrical crown part 50 in which the ring grooves 27 for the necessary or desired compression and oil rings 28 are established. The crown part 50 has an internally threaded bore entering its inner end to accommodate an annular skirt part 51 which cooperates with the crown part 50 to define the annular channel 29 in which the bearing sleeve B is engaged. The part 51 is kept engaged in the part 50 by one or more set screws 52.

In the form of the invention illustrated, the crown part 50 has a central rearwardly opening tapered cavity 32 in which its related end portion 31 of its related connecting yoke R is wedgedly engaged. The yoke R is retained in engagement with the crown part 50 by screw fastener means 53, substantially as shown.

In practice and as illustrated, the outside end edges of the bearing sleeve B are suitably beveled to eliminate the likelihood of the bearing sleeve scuffing or abrating its related cylinder.

Further, as shown, the bearing sleeve B can be and is preferably provided with a plurality of circumferentially spaced, axially and radially outwardly opening and axially and circumferentially inclined or pitched grooves 60. The grooves 60 function to: (1) conduct gases by or across the bearing ring to equalize gas pressures that might otherwise adversely affect operation of the bearing sleeve; (2) allow for the free flow of lubricating oil across and about the bearing sleeve; and, (3) induce circumferential movement of the bearing sleeve about the piston and within its related cylinder and to thereby assure uniform wear and extend the useful life expectancy of the piston, bearing sleeve, and cylinder.

Figure 19:
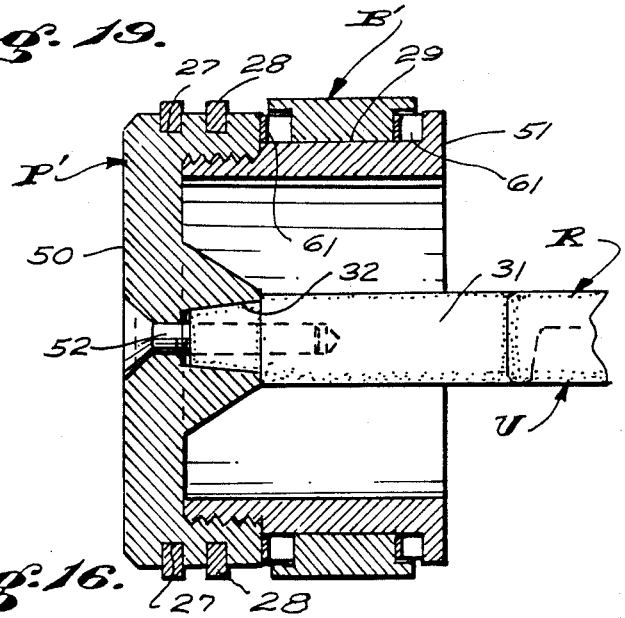
FIG. 19 is a sectional view of another form of piston assembly.
Figure 16:
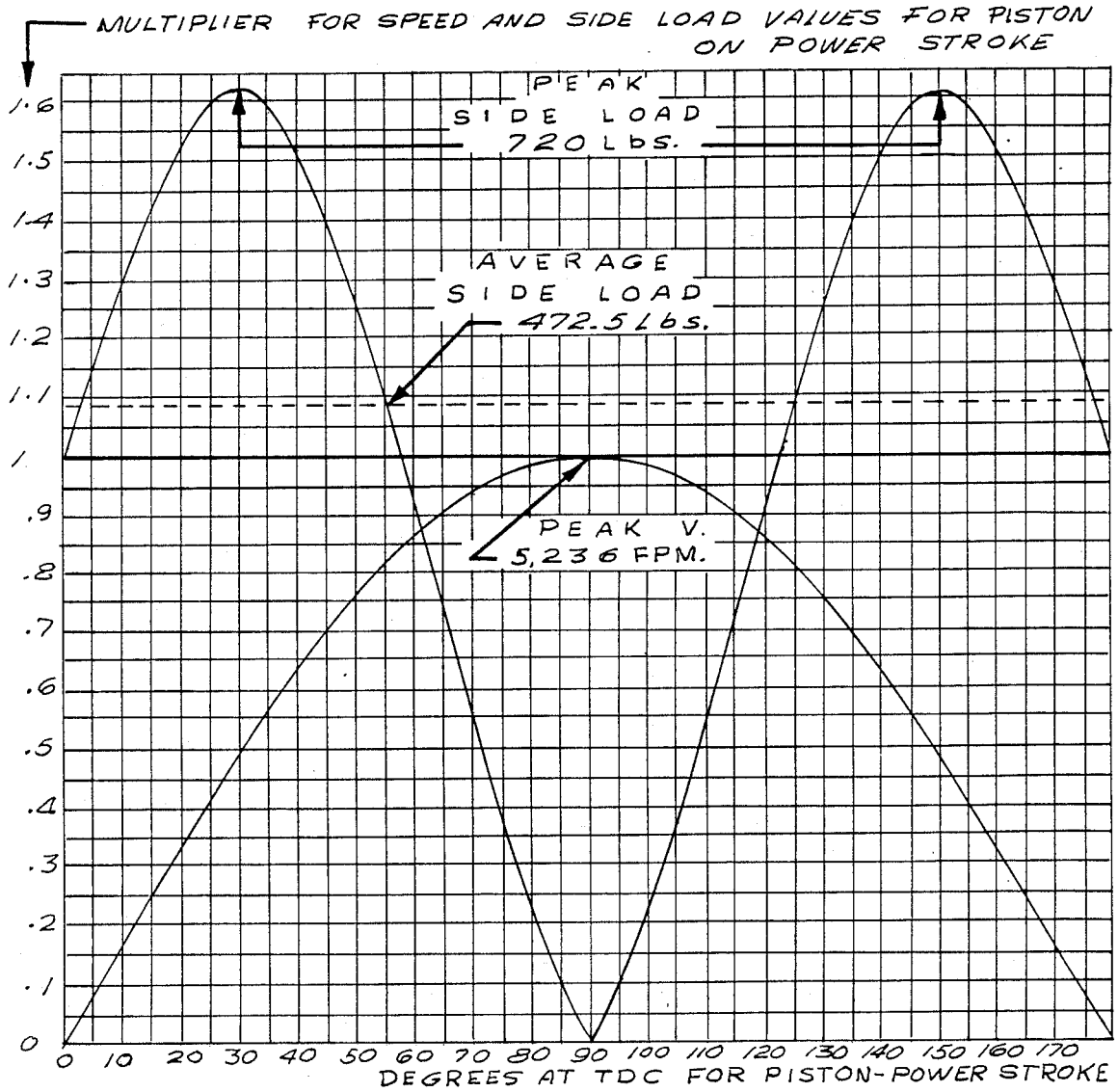
FIG. 16 is a graph showing the degree and timing of piston side loading in the engine.

In FIG. 19 of the drawings, I have shown a modified form of piston and bearing sleeve assembly P′ wherein the axial extent of the channel 29 in the piston is extended and wherein Marseille'd or other suitable formed annular, axially-compressible loading springs 61 are engaged in the channel 29 between each end thereof and its related end of the bearing sleeve B′. The opposite ends of the sleeve (as shown) are preferably provided with extensions in the nature of retaining skirts that occur readily outward of and keep the springs within the channel. The springs 61 normally yieldingly maintain the bearing sleeve mid-way between the ends of the channel. The effective axial working extent of each loading spring 61 is preferably substantially equal to the distance the piston travels during the last 30° of engine rotation before reaching and stopping at its top and bottom dead center positions and during that travel when side loading of the pistons is greatest. In the example given, that distance is about $\frac{5}{8}$″. The force of the loading springs 61 is substantially equal to and is preferably slightly less than the reactive resistance afforded by the bearing sleeve when potentially damaging frictional forces are generated between the bearing sleeve and its cylinder. With the structure here provided, if and when the sleeve B might tend to freeze or lock up in its cylinder, near the ends of its strokes, the springs 61 will yieldingly allow the bearing sleeve to move axially relative to the piston a sufficient extent to noticably reduce and/or prevent damage to the bearing sleeve and/or its related cylinder; and to provide for circumferential rotation of the bearing as the spring unloads and side loading decreases.

Figure 20:
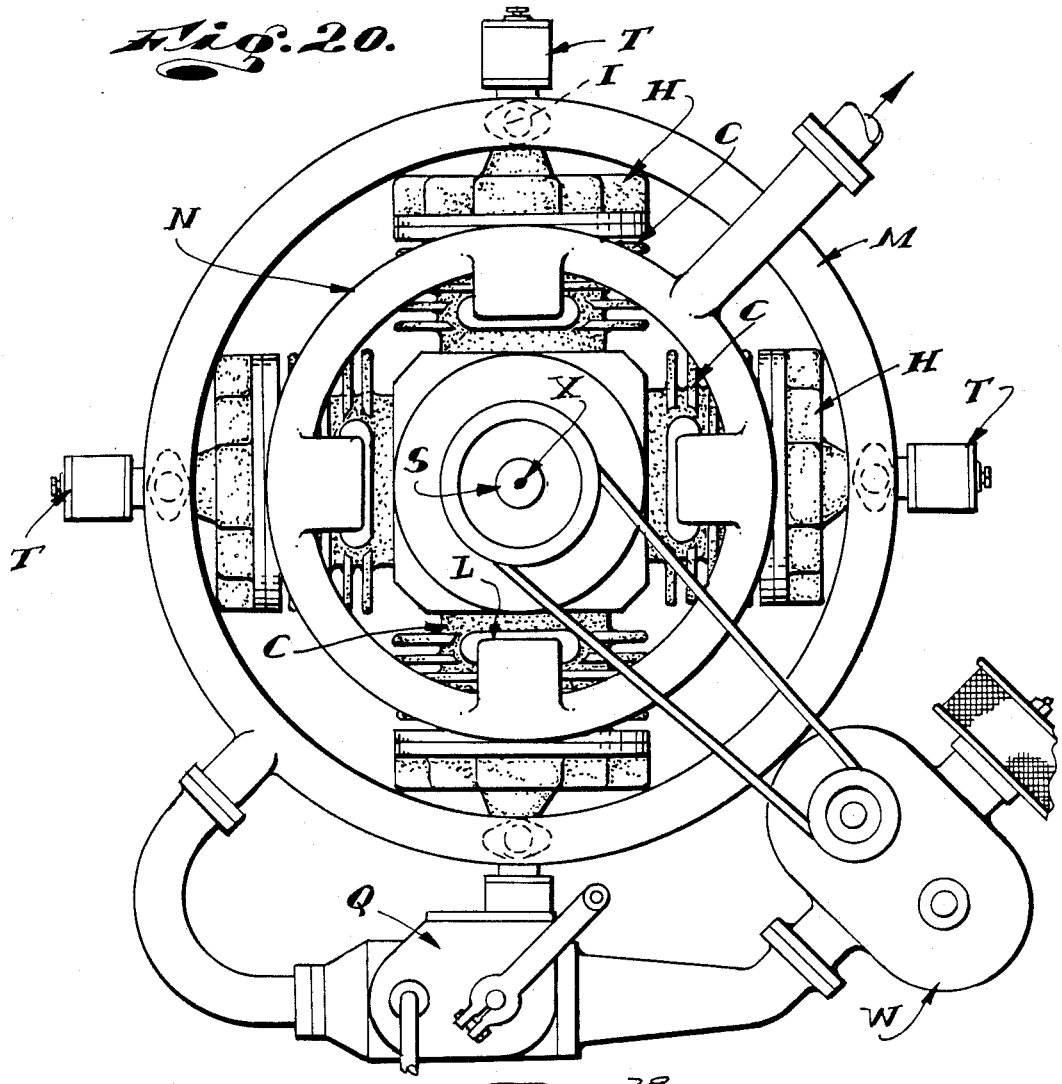
FIG. 20 is a diagramatic view of my cruciform engine with super-charger, carburetor, intake manifold, intake valve, and exhaust manifold related to it.

In FIG. 20 of the drawings, I have diagrammatically illustrated my 2-cycle cruciform engine with annular intake and exhaust manifolds M and N communicating with the inlet ports (not shown) in the cylinder heads H, and exhaust ports in the cylinders (not shown), a carburetor Q at an inlet in the manifold M, a supercharger W driven by the engine and delivering air into and through the carburetor at, for example, 10 psi.

During engine operation, after each piston of the engine has moved to open the exhaust port in its related cylinder and exhaust gases rush outward from the cylinder through the exhaust port, the inertia of the exhaust gases draws a minus pressure in the cylinder which is, for example, −5 psi. When the minus pressure is drawn in the cylinder, a pressure differential of 15 psi is created between the supercharged gases in the intake manifold and in the cylinder.

Figure 21:
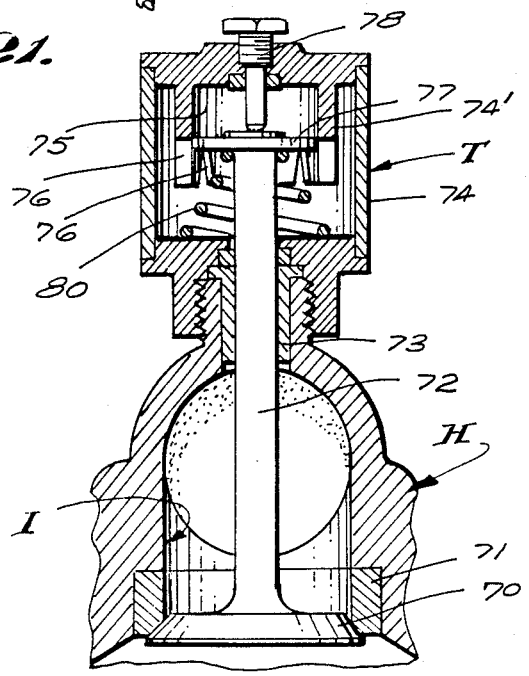
FIG. 21 is a sectional view of my new intake valve actuating mechanism.

In FIG. 21 of the drawings, I have illustrated a novel gas pressure-actuated intake valve mechanism T suitable for operating the valve V in each head H of my new engine. The valve mechanism T incorporates the intake valve V in its related cylinder head H. The valve V is a typical poppet-type valve with a disc-shaped head 70 that normally occurs in an upper or closed position where it is engaged and sealed with an annular valve seat 71 about the inlet end of the inlet port I. The valve V next includes an elongate vertically disposed, upwardly projecting valve stem 72 that is engaged in and extends upwardly through a suitable valve guide 73 engaged in and carried by the head H. The stem projects freely upwardly into a casing 74. The casing 74 has a cylindrical side wall and top and bottom end walls. The bottom end wall has an internally threaded tubular neck that depends therefrom and is engaged on and about an upwardly projecting boss on the head H. The top end wall of the casing has a downwardly projecting annular skirt 74' defining a vertically extending, downwardly opening dashpot 75, with a radially inwardly disposed cylindrical inside surface, within the casing. The lower portion of the skirt is provided with a plurality of circumferentially spaced, radially and downwardly-opening, downwardly divergent fluid-conducting gates 76. The upper end of the stem is fixed to and carries a disc-shaped, piston like plunger 77 that is normally slidably engaged in the dashpot 75 and is normally stopped adjacent and overlies or closes the upper ends of the gates 76.

In the case illustrated, the top wall of the casing carries a vertically adjustable valve stop 78 that depends into the dashpot and engages the top of the stem and/or plunger to stop the valve in proper closed position relative to the valve seat.

The mechanism T includes a suitable seal 79 at and between the bottom of the casing and the stem, and an elongate, vertical hellical compression spring 80 engaged about the stem and acting between the bottom end wall of the casing and the plunger.

In practice, the casing is filled with a suitable displacement medium such as a very light weight oil.

The spring 80 normally yieldingly urges and holds the valve up in its closed position where the plunger is up in the dashpot, adjacent to the upper ends of and closing the gates 76.

In operation, when the engine is operated and the piston P in each cylinder reaches bottom dead center, where the exhaust port L is open and a negative pressure is drawn in the cylinder, the pressure differential (15 psi) acting across the valve head 70 forcibly urges and moves the valve head 70 down and from engagement with its valve seat and moves the plunger down in the dashpot below the upper ends of the gates whereupon the valve V is moved substantially freely downwardly to its fully open position by the differential pressures acting upon it and by the downwardly moving gases flowing about it. When the piston moves up from bottom dead center and commences to close the exhaust port, the negative pressure in the cylinder is eliminated, positive pressures commence to be generated therein, the flow of inflowing gases through the port L and by the valve V is slowed, and, the spring 80 commences to move the valve V up to its closed position. The inflowing gases stop flowing when the valve V is being closed by the spring 80 and when the rapidly increasing pressure of gases in the cylinder (compressed by the piston) exceeds the supercharged or feed pressure on the gases within the intake manifold M. As the above is taking place and the valve reaches its closed position, high pressure gases in the cylinder act upon and forcibly drive the valve head into seated closed position on and with the valve seat. If unchecked, the valve will engage the valve seat with destructive speed and force. In the case at hand, the plunger moves upwardly in the dashpot and relative to the gates to progressively reduce the flow capacity of the gates and the rate at which the plunger can displace fluid from within the dashpot. The controlled restricted flow of fluid through the gate substantially slows the rate at which the valve closes and prevents the valve from striking the valve seat as it establishes seating ceiling engagement therewith.

While the above valving mechanism T has been determined to be operable by preliminary engineering drawings and calculations and by bench testing certain dashpot devices, its ultimate design and its details of construction are yet to be established. Its actual utility in any new cruciform engine throughout the full range of operating speeds it will likely encounter has yet to be determined.

It is to be understood that the valve mechanism T that I have illustrated and described above is but one intake valve operating mechanism that might be advantageously made a part of the scavenging means provided to move fluid fuel mixtures and exhaust gases into and out of the engine. In practice, any one of many ordinary or conventional valve-actuating mechanisms commonly used in the art of internal combustion reciprocating engines might be adopted and put to use in my new cruciform engine without departing from the broader aspects and spirit of my invention.

Having described only typical preferred forms and applications of my invention, I do not wish to be limited to the specific details herein set forth but wish to reserve to myself any modifications and/or variations that might appear to those skilled in the art and which fall within the scope of the following claims.

Having described my invention, I claim:

1. A cruciform reciprocating engine including a crank case, an elongate crank shaft with opposite ends rotatably supported by the case on a central turning axis and an elongate central crank pin within the case on a second axis parallel with and spaced radially outward from the turning axis, two pair of elongate cylinders with radially disposed inner and outer ends on radial axes extending radially of and intersecting the turning axis, the inner ends of the cylinders are secured to the case, the radial longitudinal axis of each pair of cylinders is at right angle to the radial longitudinal axis of the other pair of cylinders, said radial longitudinal axes are spaced axially of the crank pin, an elongate piston unit is engaged with and extends between the cylinders of each pair of cylinders, each piston unit includes an elongate yoke on a radial plane parallel with the radial longitudinal axis and normal to the turning axis, said yoke has a bearing opening intermediate its ends on an axis parallel with and spaced radially from the turning axis and from the crank pin, said yoke has opposite ends disposed toward related cylinders, an elongate cylindrical piston with radially disposed inner and outer ends is secured to each end of the yoke and is shiftably engaged in the cylinder related thereto, an elongate twin eccentric disc driver is drivingly engaged with and between the crank pin and the yokes, the driver includes a pair of axially spaced cylindrical discs, each disc is rotatably engaged in the bearing opening in a related yoke, the central axis of the discs are on spaced parallel third axes spaced radially from opposite sides of the second axis of the crank pin a distance less than one quarter their radial extent, said driver has a crank pin opening intermediate and parallel with the third axes in which the crank pin is rotatably engaged, a head is engaged on and closes the radial outer end of each cylinder; scavenging means controls the flow of fluid into and out of the cylinders; each piston has an outer portion with piston ring grooves; piston rings are engaged in the grooves for substantial free limited radial shifting therein and project from the grooves and engage the inside surface of the cylinder related thereto, each piston has an inner portion with a longitudinally elongate, radially outwardly opening bearing sleeve channel with a radially outwardly disposed cylindrical bottom and axially-spaced opposing ends; and, an elongate, annular, bearing sleeve is engaged in and projects radially outward from the channel, the bearing sleeve has radially inwardly and outwardly disposed longitudinally extending inside and outside bearing surfaces in load-transmitting bearing engagement with the bottom of the channel and the inside surface of the cylinder and has axially disposed ends opposing related ends of the channel.

2. The engine set forth in claim 1 wherein the bearing sleeves have pluralities of circumferentially spaced, radially outwardly opening, circumferentially and axially pitched grooves with outer radial edges adjacent the inside surfaces of the cylinders and cooperating therewith to define fluid passages, said edges and passages react with said inside surfaces and with fluids to cause the sleeves to move circumferentially relative to the pistons and cylinders when the pistons move longitudinally therein.

3. The engine set forth in claim 1 which further includes springs in the channels between related opposing ends of the sleeves and the channels, said springs yieldingly maintain the sleeves positioned midway between the ends of the channels and yieldingly allow limited predetermined axial movement of the sleeves in the channels.

4. The engine set forth in claim 1 wherein the bearing sleeves have pluralities of circumferentially spaced, radially outwardly opening, circumferentially and axially pitched grooves with outer radial edges adjacent the inside surfaces of the cylinders and cooperating therewith to define fluid passages, said edges and passages react with said inside surfaces and with fluids to cause the sleeves to move circumferentially relative to the pistons and cylinders when the pistons move longitudinally therein; and springs in the channels between related opposing ends of the sleeves and the channels, said springs yieldingly maintain the sleeves positioned midway between the ends of the channels and yieldingly allow limited predetermined axial movement of the sleeves in the channels.

5. The engine set forth in claim 1 which further includes springs in the channels between related opposing ends of the sleeves and the channels, said springs yieldingly maintain the sleeves positioned midway between the ends of the channels and yieldingly allow limited predetermined axial movement of the sleeves in the channels, the sleeves have annular axially-projecting retaining skirts at their opposite ends that occur radially outward from and retain the springs within the channels.

6. The engine set forth in claim 1 wherein the cross-sectional dimension of the yokes across their planes extending transverse the turning axis is sufficiently less than the inside diameter of the cylinders to establish free working clearance between the yokes and cylinders while maintaining maximum structural depth in the yokes on that plane.

7. The engine set forth in claim 1 wherein the bearing sleeves have pluralities of circumferentially spaced, radially outwardly opening, circumferentially and axially pitched grooves defining radial outer pitched edges adjacent the inside surfaces of the cylinders and cooperating therewith to defined fluid passages, the edges and passages react with the inside surfaces and with fluids to cause the sleeves to move circumferentially relative to the pistons and cylinders when the pistons move longitudinally therein, the cross-sectional dimension of the yokes across their planes extending transverse the turning axis is sufficiently less than the inside diameter of the cylinders to establish free working clearance between the yokes and cylinders while maintaining maximum structural depth in the yokes on that plane.

8. The engine set forth in claim 1 which further includes springs in the channels between the related opposing ends of the sleeves and the channels, said springs yieldingly maintain the sleeves positioned midway between the ends of the channels and yieldingly allow for limited predetermined axial movement of the sleeves in the channels, the cross-sectional dimension of the yokes across their planes extending transverse the turning axis is sufficiently less than the inside diameter of the cylinders to establish free working clearance between the yokes and the cylinders while maintaining maximum structural depth in the yokes on that plane.

9. The engine set forth in claim 1 wherein the bearing sleeves have pluralities of circumferentially spaced, radially outwardly opening, circumferentially and axially pitched grooves defining radial outer pitched edges and fluid passages that react with the inside surfaces of the cylinders and with fluids and cause the sleeves to move circumferentially relative to the pistons and cylinders when the pistons move longitudinally therein;, springs are positioned in the channels between related opposing ends of the sleeves and the channels, and said springs yieldingly maintain the sleeves positioned midway between the ends of the channels and yieldingly allow for limited predetermined axial movement of the sleeves in the channels, the cross-sectional dimension of the yokes across their planes extending transverse the turning axis is sufficiently less than the inside diameter of the cylinders to establish free working clearance therebetween while maintaining maximum structural depth in the yokes on that plane.

10. The engine set forth in claim 1 which further includes springs in the channels between related opposing ends of the sleeves and the channels, said springs yieldingly maintain the sleeves positioned midway between the ends of the channels and yieldingly allow for limited predetermined axial movement of the sleeves in the channels, the sleeves have annular axially-projecting retaining skirts at their opposite ends that occur radially outward from and retain the springs within the channels, the cross-sectional dimension of the yokes across their planes extending transverse the turning axis is sufficiently less than the inside diameter of the cylinders to establish free working clearance therein while maintaining maximum structural depth in the yokes on that plane.

11. The engine set forth in claim 1 wherein said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft.

12. The engine set forth in claim 1 wherein said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft, said valves includes elongate longitudinally shiftable stems with outer ends projecting from the heads, the valve-actuating means includes compression springs normally yieldingly urging the valve stems outwardly and the valve in closed relationship with their related valve seats, dashpots at the outer ends of the stems to slow movement of the valves into and out of closed position with the valve seats, the valves are moved from their closed positions to their open positions relative to the valve seats by increased pressure differentials between the cylinders and the intake manifold when the exhaust ports are opened.

13. The engine set forth in claim 1 wherein the bearing sleeves have pluralities of circumferentially spaced, radially outwardly opening, circumferentially and axially pitched grooves with outer radial edges adjacent the inside surfaces of the cylinders and cooperating therewith to define fluid passages, said edges and passages react with said inside surfaces and with fluids to cause the sleeves to move circumferentially relative to the pistons and cylinders when the pistons move longitudinally therein, said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft.

14. The engine set forth in claim 1 wherein the bearing sleeves have pluralities of circumferentially spaced, radially outwardly opening, circumferentially and axially pitched grooves with outer radial edges adjacent the inside surfaces of the cylinders and cooperating therewith to define fluid passages, said edges and passages react with said inside surfaces and with fluids to cause the sleeves to move circumferentially relative to the pistons and cylinders when the pistons move longitudinally therein; and springs in the channels between related opposing ends of the sleeves and the channels, said springs yieldingly maintain the sleeves positioned midway between the ends of the channels and yieldingly allow limited predetermined axial movement of the sleeves in the channels, said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft.

15. The engine set forth in claim 1 wherein the bearing sleeves have pluralities of circumferentially spaced, radially outwardly opening, circumferentially and axially pitched grooves defining radial outer pitched edges adjacent the inside surfaces of the cylinders and cooperating therewith to define fluid passages, the edges and passages react with the inside surfaces and with fluids to cause the sleeves to move circumferentially relative to the pistons and cylinders when the pistons move longitudinally therein, the cross-sectional dimension of the yokes across their planes extending transverse to turning axis is sufficiently less than the inside diameter of the cylinders to establish free working clearance between the yokes and cylinders while maintaining maximum structural depth in the yokes on that plane, said scavenging means includes exhaust ports in the cylinders by which the pistons move, inlet ports with annular valve seats in the heads, elongate longitudinally-shiftable poppet valves shiftable longitudinally inwardly and outwardly between open and close positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft.

16. The engine set forth in claim 1 wherein the bearing sleeves have pluralities of circumferentially spaced, radially outwardly opening, circumferentially and axially pitched grooves defining radial outer pitched edges and fluid passages that react with the inside surfaces of the cylinders and with fluids and cause the sleeves to move circumferentially relative to the pistons and cylinders when the pistons move longitudinally therein;, springs are positioned in the channels between related opposing ends of the sleeves and the channels, said springs yieldingly maintain the sleeves positioned midway between the ends of the channels and yieldingly allow for limited predetermined axial movement of the sleeves in the channels, the cross-sectional dimension of the yokes across their planes extending transverse the turning axis is sufficiently less than the inside diameter of the cylinders to establish free working clearance therebetween while maintaining maximum structural depth in the yokes on that plane, said valve means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft.

17. The engine set forth in claim 1 wherein the bearing sleeves have pluralities of circumferentially spaced, radially outwardly opening, circumferentially and axially pitched grooves with outer radial edges adjacent the inside surfaces of the cylinders and cooperating therewith to define fluid passages, said edges and passages react with said inside surfaces and with fluids to cause the sleeves to move circumferentially relative to the pistons and cylinders when the pistons move longitudinally therein; and springs in the channels between related opposing ends of the sleeves and the channels, said springs yieldingly maintain the sleeves positioned midway between the ends of the channels and yieldingly allow limited predetermined axial movement of the sleeves in the channels, said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft, said valves include elongate longitudinally shiftable stems with outer ends projecting from the heads, the valve-actuating means includes compression springs normally yieldingly urging the valve stems outwardly and the valve in closed relationship with their related valve seats, dashpots at the outer ends of the stems to slow movement of the valves into and out of closed position with the valve seats, the valves are moved from their closed positions to their open positions relative to the valve seats by increased pressure differentials between the cylinders and the intake manifold when the exhaust ports are opened.

18. The engine set forth in claim 1 wherein the bearing sleeves have pluralities of circumferentially spaced, radially outwardly opening, circumferentially and axially pitched grooves defining radial outer pitched edges adjacent the inside surfaces of the cylinders and cooperating therewith to define fluid passages, the edges and passages react with the inside surfaces and with fluids to cause the sleeves to move circumferentially relative to the pistons and cylinders when the pistons move longitudinally therein, the cross-sectional dimension of the yokes across their planes extending transverse the turning axis is sufficiently less than the inside diameter of the cylinders to establish free working clearance between the yokes and cylinders while maintaining maximum structural depth in the yokes on that plane, said scavenging means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft, said valves include elongate longitudinally shiftable stems with outer ends projecting from the heads, the valve-actuating means includes compression springs normally yieldingly urging the valve stems outwardly and the valve in closed relationship with their related valve seats, dashpots at the outer ends of the stems to slow movement of the valves into and out of closed position with the valve seats, the valves are moved from their closed positions to their open positions relative to the valve seats by increased pressure differentials between the cylinders and the intake manifold when the exhaust valves are opened.

19. The engine set forth in claim 1 wherein the bearing sleeves have pluralities of circumferentially spaced, radially outwardly opening, circumferentially and axially pitched grooves defining radial outer pitched edges and fluid passages that react with the inside surfaces of the cylinders and with fluids and cause the sleeves to move circumferentially relative to the pistons and cylinders when the pistons move longitudinally therein; springs are positioned in the channels between related opposing ends of the sleeves and the channels, said springs yieldingly maintain the sleeves positioned midway between the ends of the channels and yieldingly allow for limited predetermined axial movement of the sleeves in the channels, the cross-sectional dimension of the yokes across their planes extending transverse the turning axis is sufficiently less than the inside diameter of the cylinders to establish free working clearance therebetween while maintaining maximum structural depth in the yokes on that plane, said valve means includes exhaust ports in the cylinders by which the pistons move, inlet ports with annular valve seats in the heads, elongate longitudinally-shiftable poppet valves shiftable longitudinally inwardly and outwardly between open and closed positions relative to the valve seats, an exhaust manifold communicates with the exhaust ports, an inlet manifold communicates with the inlet ports, a fuel and air-mixing device has an outlet connected with the intake manifold and an inlet connected with the outlet of an air pump driven from the crank shaft, said valves include elongate longitudinally shiftable stems with outer ends projecting from the heads, the valve-actuating means includes compression springs normally yieldingly urging the valve stems outwardly and the valve in closed relationship with their related valve seats, dashpots at the outer ends of the stems to slow movement of the valves into and out of closed position with the valve seats, the valves are moved from their closed positions to their open positions relative to the valve seats by increased pressure differentials between the cylinders and the intake manifold when the exhaust ports are opened.

* * * * *